US010045599B1

(12) United States Patent
Berry

(10) Patent No.: US 10,045,599 B1
(45) Date of Patent: Aug. 14, 2018

(54) LUGGAGE SECURITY SYSTEM AND METHOD OF USE

(71) Applicant: Barbara B. Berry, Naples, FL (US)

(72) Inventor: Barbara B. Berry, Naples, FL (US)

( * ) Notice: Subject to any disclaimer, the term of this patent is extended or adjusted under 35 U.S.C. 154(b) by 0 days.

(21) Appl. No.: 15/624,013

(22) Filed: Jun. 15, 2017

(51) Int. Cl.
*A45C 5/03* (2006.01)
*A45C 13/18* (2006.01)
*G08B 13/08* (2006.01)

(52) U.S. Cl.
CPC ..... *A45C 13/18* (2013.01); *A45C 5/03* (2013.01); *G08B 13/08* (2013.01)

(58) Field of Classification Search
CPC ..... A45C 13/18; A45C 5/03
USPC ..... 340/541
See application file for complete search history.

(56) References Cited

U.S. PATENT DOCUMENTS

| | | | | |
|---|---|---|---|---|
| 6,304,183 | B1 | 10/2001 | Causey | |
| 8,434,577 | B1 | 5/2013 | Al-Qaffas | |
| 8,847,760 | B1 * | 9/2014 | Watkins, Jr. ..... | A45C 13/24 340/568.1 |
| 8,964,037 | B2 * | 2/2015 | Petricoin, Jr. ..... | H04N 7/18 340/568.7 |
| 9,443,366 | B2 | 9/2016 | Rayner | |
| 9,609,932 | B2 | 4/2017 | Mercado | |

FOREIGN PATENT DOCUMENTS

| | | |
|---|---|---|
| CN | 104522979 | 12/2014 |
| CN | 105533982 | 5/2016 |

* cited by examiner

*Primary Examiner* — Qutbuddin Ghulamali
(74) *Attorney, Agent, or Firm* — Edward M. Livingston, Esq.; Bryan L. Loeffler, Esq.; Livingston Loeffler, P.A.

(57) ABSTRACT

A security system for luggage, such as suitcases, carrying bags and so forth, wherein a sensor (3) placed inside a piece of luggage (2) proximate to an opening of the piece of luggage. When the piece of luggage is opened or closed an alert with a time stamp is sent to notify an owner of the piece of luggage of the event.

20 Claims, 2 Drawing Sheets

LUGGAGE SECURITY SYSTEM AND METHOD OF USE

FIELD OF THE INVENTION

This invention relates to luggage and more particularly to a security system for luggage that monitors the opening of unattended luggage in an effort to deter theft and/or provide proof of theft.

BACKGROUND OF THE INVENTION

Luggage, such as suitcases, purses, briefcases, computer cases, and various other storage devices, are commonly utilized while traveling. Conventional luggage may typically be "locked" to prevent an unauthorized third-party from opening the luggage. However, between destinations especially in relation to air travel, individuals must typically leave their luggage in the care of the airline. During this time, the luggage may be handled by a number of different individuals creating a chain of custody. Many of these individuals may access the luggage for official reasons, in the case of TSA or security, and/or for unscrupulous reasons, in the case of baggage handlers or other third parties seeking to steal contents of the luggage. The same is true for luggage left unattended, such as luggage left in a hotel room. All of these circumstances leave the luggage and contents thereof vulnerable to theft.

In either case, the owner of the luggage has no evidence to prove the luggage was accessed while the luggage was out of their possession, especially the specific time the luggage was accessed. Therefore, it is nearly impossible to prove when and thus, where and by whom the luggage was accessed after articles are noticed as being stolen from inside the luggage.

For example, if the owner of the luggage is able to prove a piece of luggage was opened at a specific time, then an airline can determine at what point during a chain of custody the piece of luggage was opened and why it was opened, thereby increasing the odds that a thief will be caught and/or any stolen items may be recovered. With regard to hotels, a hotel can check the time the piece of luggage was opened against a record of hotel employees, such as maids, entering a hotel room where the luggage was left unattended.

Therefore, a need exists for a luggage security system and method of use that records and provides a time stamp of when a piece of luggage was opened and/or closed which may be used as evidence that articles were stolen from inside the piece of luggage.

SUMMARY OF THE INVENTION

The primary object of the present invention is to provide a luggage security system and method of use that records and provides a time stamp of when a piece of luggage was opened and/or closed which may be used as evidence that articles were stolen from inside the piece of luggage.

The present invention fulfills the above and other objects by providing a security system for luggage, such as suitcases, carrying bags and so forth, wherein a sensor placed inside a piece of luggage proximate to an opening of the piece of luggage. The sensor is preferably a magnetic sensor having two sides or halves that form a connection when the piece of luggage is sealed shut, thereby sending an alert with a time stamp confirming when the piece of luggage was shut. When the piece of luggage is opened, the connection is broken and the sensor sends an alert with a time stamp confirming when the piece of luggage was opened. The alert may be saved in a local database connected to the sensor that can be accessed manually or to a remote electronic device, server, smart phone via text or email and so forth where a log is created showing the various dates and times that the piece of luggage was opened and/or closed.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
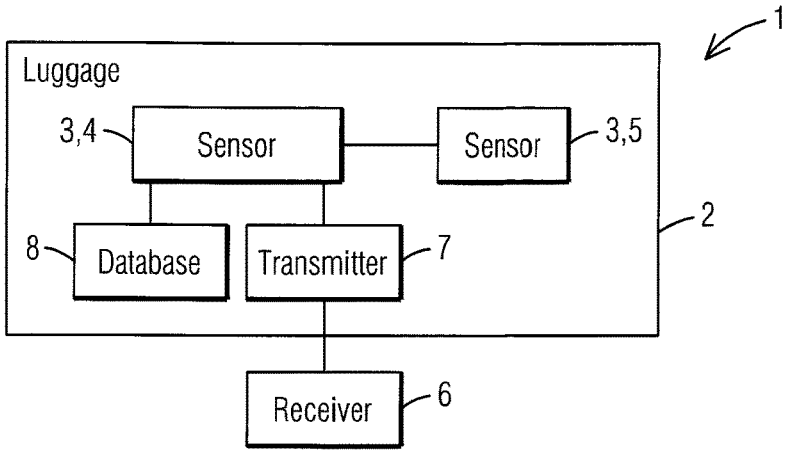
FIG. 1 is a block diagram of components of a luggage security system of present invention wherein a piece of luggage in a closed position.
Figure 5:
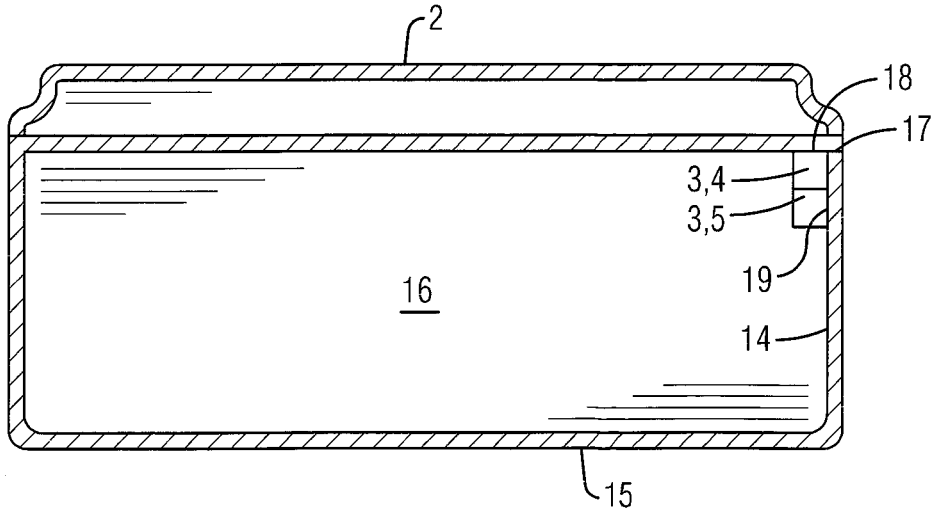
FIG. 5 is a cross sectional bottom view along line 5-5 of FIG. 4 of the piece of luggage.

For purposes of describing the preferred embodiment, the terminology used in reference to the numbered accessories in the drawings is as follows:

1. luggage security system, generally
2. piece of luggage
3. sensor
4. first half of sensor
5. second half of sensor
6. receiver
7. transmitter
8. database
9. mounting sensor in piece of luggage
10. sending closed alert
11. closed time stamp
12. sending open alert
13. open time stamp
14. inner surface
15. outer surface
16. storage area
17. opening
18. first side of opening
19. second side of opening With reference to FIG. 1, a block diagram of components of a luggage security system 1 of present invention wherein a piece of luggage 2 in a closed position is illustrated. The present invention comprises a sensor 3, such as a reed switch sensor, magnetic sensor, proximity sensor or equivalent sensor, wherein the sensor 3 comprises a first half 4 and a second half 5 that, when placed next to each other, form a circuit that causes an alert to be sent to a receiver 6, such as a remote electronic device, smart phone, remote server, tablet, computer and so forth, via a transmitter 7 and/or for the alert to be stored in a local database 8. The sensor 3 is preferably mounted on an inner surface of a piece of luggage wherein the first half and second half of the sensor are located on opposing sides of an opening of the piece of luggage 2, as illustrated in FIG. 5. Therefore, when the piece of luggage 2 is closed, a circuit is formed or broken creating an alert containing information, such as the fact that the piece of luggage 2 was closed, the date the piece of luggage was closed and the time the piece of luggage 2 was closed or a time stamp.

Figure 2:
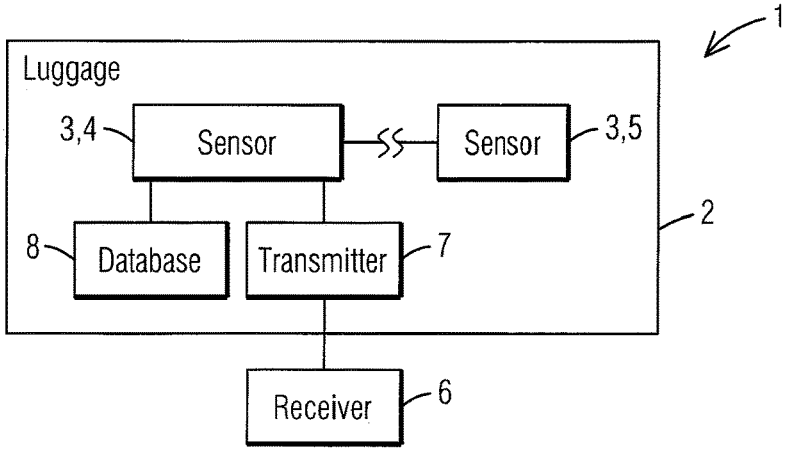
FIG. 2 is a block diagram of components of a luggage security system of present invention wherein a piece of luggage in an opened position.

With reference to FIG. 2, a block diagram of components of a luggage security system 1 of present invention wherein a piece of luggage 2 in an opened position is illustrated. The present invention comprises a sensor 3, such as a reed switch sensor, magnetic sensor, proximity sensor or equivalent sensor, wherein the sensor 3 comprises a first half 4 and a second half 5 that, when placed next to each other, form a circuit that causes an alert to be sent to a receiver 6, such as a remote electronic device, smart phone, remote server, tablet, computer and so forth, via a transmitter 7 and/or for the alert to be stored in a local database 8. The sensor 3 is preferably mounted on an inner surface of a piece of luggage wherein the first half and second half of the sensor are located on opposing sides of an opening of the piece of luggage 2, as illustrated in FIG. 5. Therefore, when the piece of luggage 2 is opened, a circuit is formed or broken creating an alert containing information, such as the fact that the piece of luggage 2 was opened, the date the piece of luggage 2 was opened and the time the piece of luggage 2 was opened or a time stamp.

Figure 3:
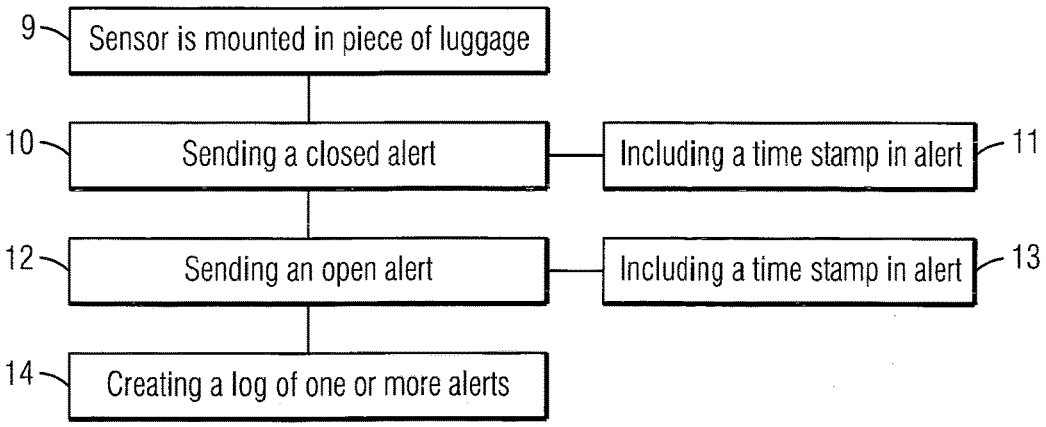
FIG. 3, a flow chart showing a method the present invention for monitoring a piece of luggage.

With reference to FIG. 3, a flow chart showing a method the present invention for monitoring a piece of luggage is illustrated. First, a sensor, such as a reed switch sensor, magnetic sensor proximity sensor or equivalent, wherein the sensor comprises a first half and a second half is mounted on an interior surface of a piece of luggage 9. Said first half and second half being mounted on opposing sides of an opening of the piece of luggage so that when the piece of luggage is closed the first half and the second half are making contact and/or are directly adjacent to each other. Sending a closed alert to a database and/or receiver when the piece of luggage is closed and the first half and the second half are making contact and/or are directly adjacent to each other 10. Said closed alert comprising a date and time of when the piece of luggage was closed 11. Sending an open alert to a database and/or receiver when the piece of luggage is opened and the first half and the second half of the sensor are separated from each other. Said open alert comprising a date and time of when the piece of luggage was opened 12. Creating a log of one or more alerts 13.

Figure 4:
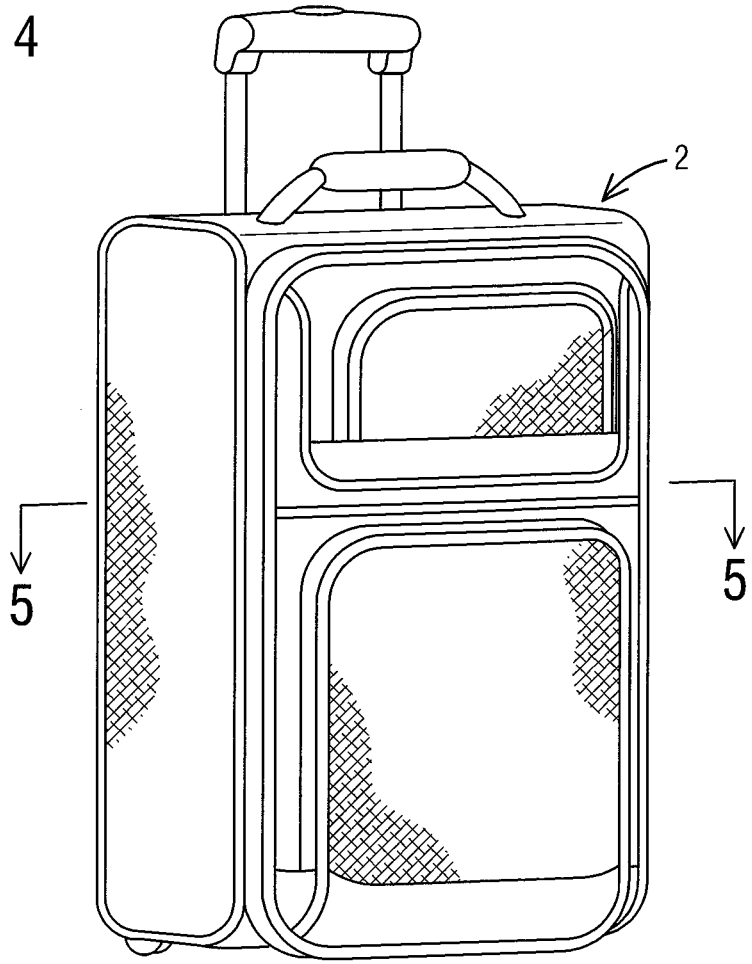
FIG. 4 is a perspective side view of a piece of luggage.

With reference to FIGS. 4 and 5, a perspective side view of a piece of luggage 2 and a cross sectional bottom view along line 5-5 of FIG. 4 of the piece of luggage 2, respectively, are illustrated. The piece of luggage 2 comprises an inner surface 14, an outer surface 15 and an inner storage area 16 accessible by a sealable opening 17 having a first side 18 and a second side 19. A sensor 3, such as a reed switch sensor, magnetic sensor, proximity sensor or equivalent sensor, wherein the sensor 3 comprises a first half 4 and a second half 5 are preferably mounted on the inner surface 14 of the piece of luggage 2 wherein the first half 4 and second half 5 of the sensor 3 are located the first side 18 and second side 19 of the opening 17. The sensor 3 may be integrated into the piece of luggage 2, permanently attached to the piece of luggage 2 and/or temporarily attached to the piece of luggage via an attachment means, such as clips, adhesives, hook and loop fasteners or equivalent attachment means. Therefore, when the piece of luggage 2 is opened or closed an alert is created and transmitted to a database and/or receiver with the date and time the piece of luggage 2 was opened or closed.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A luggage security system comprising:

a piece of luggage having an inner surface, an outer surface and an inner storage area;

said piece of luggage having a sealable opening located between a first side and a second side;

a sensor having a first half;

mounted on the inner surface of the piece of luggage on the first side of the opening;

said sensor having a second half mounted on the inner surface of the piece of luggage on the second side of the opening;

a transmitter connected to said sensor and located within said piece of luggage;

said second half of sensor being mounted on the inner surface of the piece of luggage on the second side of the opening directly opposite of the first half of the sensor so that when the opening is in a closed position, the first half of the sensor and the second half of the sensor are in contact with each other;

an alert containing a time stamp being transmitted by said transmitter when the opening is in a closed position and the first half of the sensor and the second half of the sensor are in contact with each other; and an alert containing a time stamp being transmitted by said transmitter when the opening is in an open position and the first half of the sensor and the second half of the sensor are not in contact with each other.

2. The luggage security system of claim 1 wherein:

said alert being stored in a log connected to said receiver.

3. The luggage security system of claim 2 wherein:

said sensor is a reed switch sensor.

4. The luggage security system of claim 2 wherein:

said sensor is a magnetic sensor.

5. The luggage security system of claim 2 wherein:

said sensor is a proximity sensor.

6. The luggage security system of claim 1 wherein:

said sensor is a reed switch sensor.

7. The luggage security system of claim 1 wherein:

said sensor is a magnetic sensor.

8. The luggage security system of claim 1 wherein:

said sensor is a proximity sensor.

9. A luggage security system comprising:

a piece of luggage having an inner surface, an outer surface and an inner storage area;

said piece of luggage having a sealable opening located between a first side and a second side;

a sensor having a first half mounted on the inner surface of the piece of luggage on the first side of the opening;

said sensor having a second half mounted on the inner surface of the piece of luggage on the second side of the opening;

a transmitter connected to said sensor and located within said piece of luggage;

said second half of sensor being mounted on the inner surface of the piece of luggage on the second side of the opening directly opposite of the first half of the sensor so that when the opening is in a closed position, the first half of the sensor and the second half of the sensor are in contact with each other;

a database being connected to said transmitter;

an alert containing a time stamp being transmitted by said transmitter to said database when the opening is in a closed position and the first half of the sensor and the second half of the sensor are in contact with each other; and an alert containing a time stamp being transmitted by said transmitter to said database when the opening is in an open position and the first half of the sensor and the second half of the sensor are not in contact with each other.

10. The luggage security system of claim 9 wherein:

said alert being stored in a log connected to said receiver.

11. The luggage security system of claim 10 wherein:

said sensor is a reed switch sensor.

12. The luggage security system of claim 10 wherein:

said sensor is a magnetic sensor.

13. The luggage security system of claim 10 wherein:

said sensor is a proximity sensor.

14. The luggage security system of claim 9 wherein:

said sensor is a reed switch sensor.

15. The luggage security system of claim 9 wherein:

said sensor is a magnetic sensor.

16. The luggage security system of claim 9 wherein:

said sensor is a proximity sensor.

17. A luggage security system comprising:

a piece of luggage having an inner surface, an outer surface and an inner storage area;

said piece of luggage having a sealable opening located between a first side and a second side;

a sensor having a first half mounted on the inner surface of the piece of luggage on the first side of the opening;

said sensor having a second half mounted on the inner surface of the piece of luggage on the second side of the opening;

a transmitter connected to said sensor and located within said piece of luggage;

said second half of sensor being mounted on the inner surface of the piece of luggage on the second side of the opening directly opposite of the first half of the sensor so that when the opening is in a closed position, the first half of the sensor and the second half of the sensor are in contact with each other;

a receiver connected to said transmitter;

an alert containing a time stamp being transmitted by said transmitter to said receiver when the opening is in a closed position and the first half of the sensor and the second half of the sensor are in contact with each other;

an alert containing a time stamp being transmitted by said transmitter to said receiver when the opening is in an open position and the first half of the sensor and the second half of the sensor are not in contact with each other; and said alert being stored in a log connected to said receiver.

18. The luggage security system of claim 17 wherein:

said sensor is a reed switch sensor.

19. The luggage security system of claim 17 wherein:

said sensor is a magnetic sensor.

20. The luggage security system of claim 17 wherein:

said sensor is a proximity sensor.

* * * * *